US009487315B2

(12) United States Patent
Poutot et al.

(10) Patent No.: US 9,487,315 B2
(45) Date of Patent: Nov. 8, 2016

(54) MACHINE FOR PACKAGING ARTICLES INTO CARTONS

(75) Inventors: Benoit Poutot, Chevigny Saint Sauveur (FR); Pascal Martini, Le Poinconnet (FR); Jean Christophe Bonnain, Chateauroux (FR)

(73) Assignee: WestRock Packaging Systems, LLC, Norcross, GA (US)

( * ) Notice: Subject to any disclaimer, the term of this patent is extended or adjusted under 35 U.S.C. 154(b) by 776 days.

(21) Appl. No.: 13/260,594

(22) PCT Filed: Mar. 26, 2010

(86) PCT No.: PCT/US2010/028809

§ 371 (c)(1),
(2), (4) Date: Dec. 6, 2011

(87) PCT Pub. No.: WO2010/111579

PCT Pub. Date: Sep. 30, 2010

(65) Prior Publication Data

US 2012/0096808 A1 Apr. 26, 2012

(30) Foreign Application Priority Data

Mar. 27, 2009 (GB) ..... 0905291.1

(51) Int. Cl.

| | |
|---|---|
| ***B65B 5/06*** | (2006.01) |
| ***B65B 21/24*** | (2006.01) |
| ***B65B 5/02*** | (2006.01) |

(52) U.S. Cl.

CPC ..... *B65B 21/242* (2013.01); *B65B 5/024* (2013.01)

(58) Field of Classification Search

CPC ..... B65B 11/06; B65B 11/48; B65B 21/24; B65B 21/06; B65B 21/12; B65B 21/242; B65B 5/00; B65B 5/02; B65B 5/024; B65B 5/105; B65B 59/00; B65B 2210/02; B65B 2220/16; B65B 1/04; B65B 43/285; B65B 61/207; B65B 11/18; B65B 5/06

USPC ..... 53/458, 461, 253, 247–252, 564, 170, 53/48.1, 48.4, 48.6–48.8, 580, 397–398, 53/235

See application file for complete search history.

(56) References Cited

U.S. PATENT DOCUMENTS 3,555,776 A * 1/1971 Nigrelli et al. ..... 53/580
4,250,693 A * 2/1981 Andersson ..... 53/543

(Continued)

FOREIGN PATENT DOCUMENTS

EP 1796965 B1 11/2008
WO 2007145721 A1 12/2007

(Continued)

*Primary Examiner* — Gloria R Weeks

(74) *Attorney, Agent, or Firm* — WestRock Intellectual Property Group

(57) ABSTRACT

A packaging machine (10) for continuously packaging articles (B) comprising a first conveyor line (23), a second conveyor line (22*a*, 22*b*, 22*c*) and a transfer mechanism (26*a*, 26*b*) which transfers articles (B) from the first conveyor line to the second conveyor line into a primary or intermediate carton (C) or transfers primary or intermediate cartons (C) from a second conveyor line to the articles (B) and a second transfer mechanism which transfers packaged articles (B) in said primary or intermediate cartons (C) from the first conveyor line to the second conveyor line to be packaged in secondary or final cartons (T) or transfers articles (B) from the first conveyor to the second conveyor to be packaged directly in the secondary or final cartons (T) or which second transfer mechanism is adapted for reorientation of articles (B) or packaged articles (B) in said primary or intermediate cartons (C) or which second transfer mechanism is idle allowing primary or intermediate cartons to pass for further processing.

20 Claims, 11 Drawing Sheets

(56) References Cited

U.S. PATENT DOCUMENTS

| | | | | | |
|---|---|---|---|---|---|
| 4,578,927 | A * | 4/1986 | Scarpa et al. | 53/506 | |
| 5,148,654 | A * | 9/1992 | Kisters | 53/462 | |
| 5,501,318 | A * | 3/1996 | Disrud | 198/732 | |
| 5,692,361 | A * | 12/1997 | Ziegler et al. | 53/447 | |
| 5,724,785 | A * | 3/1998 | Malanowski | 53/48.1 | |
| 5,727,365 | A * | 3/1998 | Lashyro et al. | 53/448 | |
| 6,058,679 | A * | 5/2000 | Ziegler et al. | 53/448 | |
| 7,316,103 | B2 * | 1/2008 | Ford | B65B 5/068 | 53/228 |
| 7,543,423 | B2 * | 6/2009 | Long | B65B 25/145 | 53/237 |
| 2005/0262814 | A1 | 12/2005 | Battisti | | |
| 2007/0227101 | A1 | 10/2007 | Simm | | |
| 2008/0245035 | A1 * | 10/2008 | Ford | 53/458 | |
| 2011/0030311 | A1 * | 2/2011 | Martini | 53/154 | |
| 2011/0036684 | A1 * | 2/2011 | Bonnain | 198/418.7 | |

FOREIGN PATENT DOCUMENTS

| | | | | |
|---|---|---|---|---|
| WO | 2008058176 | A1 | 5/2008 | |
| WO | WO 2008058176 | A1 * | 5/2008 | B65B 65/00 |
| WO | 2009114332 | A2 | 11/2009 | |
| WO | 2010003083 | A2 | 1/2010 | |
| WO | 2010003146 | A2 | 1/2010 | |

* cited by examiner

MACHINE FOR PACKAGING ARTICLES INTO CARTONS

FIELD OF THE INVENTION

The invention relates to a packaging machine and a method of packaging articles. More particularly, but not exclusively, the invention relates to a method of manipulating articles in a stream of articles and an apparatus for carrying out the method and a packaging machine having a layout which is capable of processing multiple carton types and formats.

BACKGROUND OF THE INVENTION

In the field of packaging it is often required to provide consumers with a package comprising multiple primary product containers, such multi-packs are desirable for shipping and distribution and for display of promotional information.

It is known to automate packaging of the primary product into a package by placing that primary product into a carton formed from a carton blank.

It is also desirable to produce a packaging machine which can be coupled to the output of the processing machinery which produces the primary product, for example a bottling or canning machine. It may be further desirable to reorganise the output stream of primary products to facilitate placement into a cartons.

In addition an objective of the present invention is to provide a packaging machine having a layout which is capable of processing a variety of different carton formats for example wrap around carton, basket carriers, fully enclosed cartons, and to be able to side or end load, top load or bottom load the chosen carton format. Furthermore it is desirable to be able to rapidly change the format or layout of the packaging machine to adapt to the carton format or loading method required.

It is further desirable to minimise the handling of products or packages to reduce the likelihood of damage to the same.

It is further desirable to reduce complexity of the machine and hence costs by minimising the costs for example by reducing the number of subsystems required to handle the articles and hence reduce the number of drive motors that need to be incorporated and controlled.

SUMMARY OF INVENTION

According to a first aspect of the present invention there is provided a packaging machine for continuously packaging articles into cartons of different types comprising

- a first processing line for receiving articles;
- a second processing line for receiving cartons;
- a third processing line for receiving tertiary cartons;
- a first handling device for transferring articles or cartons between the first and second processing lines; and
- a second handling device for transferring articles or secondary packages between the first and third processing lines
- wherein the machine is operable in a first mode in which cartons are transferred by the first handling device from the second processing line to the first processing line to receive a group of articles to form secondary packages which secondary packages are transferred by the second handling device from the first processing line to the third processing line for application of tertiary cartons and/or subsequent processing, and

- wherein the machine is operable in a second mode of operation in which articles are transferred from the first processing line into cartons on the second processing line by the first handling device to form secondary packages which secondary packages are transferred to the third processing line for application of tertiary cartons and/or further processing, and
- wherein the machine is operable in a third mode of operation in which articles are transferred from the first processing line by either the first or second handling device to the third processing line for direct application of tertiary cartons to the articles and further processing.

Preferably, at least two of said first, second or third processing lines are parallel to one another.

Preferably, wherein at least two of the first, second or third processing lines are co-linear.

Preferably, at least one of said processing lines at least partially overlaps with another of said processing lines.

Preferably, the first and second processing lines are parallel to one another, and overlap in a direction transverse to article flow at least in part, the second and third processing lines are co-linear with one another and the first and third processing lines are parallel with one another and overlap in a direction transverse to article flow at least in part.

Preferably, the second processing line comprises a conveyor which is adaptable to accommodate cartons of different types.

Preferably, said second processing line comprises a pair of parallel conveyors spaced apart from one another and moveable with respect to one another in a direction transverse to the direction of carton flow.

Preferably, said second processing line comprises a pair of parallel conveyors spaced apart from one another and moveable with respect to one another in the direction of carton flow.

Preferably, the conveyors comprise lug assemblies for engaging cartons, which lug assemblies are adaptable in height.

Preferably, the lug assemblies are extendable in height preferably being telescopic.

Preferably, the third processing line can receive an input of products to be conveyed or processed from either of the first or second processing lines.

Preferably, the third processing line can receive said products at an end or a side thereof.

Preferably, the third processing line is coupled to the first and second processing lines to receive products at its end from one of said first or second processing lines and at the side from the other of said first or second processing lines.

Preferably, in the first mode of operation the cartons are either bottom loaded with articles or wrapped around groups of articles depending upon the carton type.

Preferably, in the second mode of operation the cartons are either top loaded or side loaded with articles depending upon the carton type.

Preferably, the second processing line comprises a hopper for supplying carton blanks and an erection device for erecting said carton blanks into a tubular form.

Preferably, the third processing line comprises a hopper for supplying tertiary carton blanks and an erection mechanism for erecting said package blanks into packages.

According to a second aspect of the present invention there is provided a packaging machine for continuously packaging articles comprising:

- a first conveyor line;
- a second conveyor line; and a transfer mechanism which transfers articles from the first conveyor line to the second conveyor line into primary or intermediate cartons or transfers primary or intermediate cartons from a second conveyor line to the articles; and a second transfer mechanism which transfers packaged articles in said primary or intermediate cartons from the first conveyor line to the second conveyor line to be packaged in secondary or final cartons or transfers articles from the first conveyor to the second conveyor to be packaged directly in the secondary or final cartons or which second transfer mechanism is adapted for reorientation of articles or packaged articles in said primary or intermediate cartons or which second transfer mechanism is idle allowing primary or intermediate cartons to pass for further processing.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS OF THE PRESENT INVENTION

Figure 1:
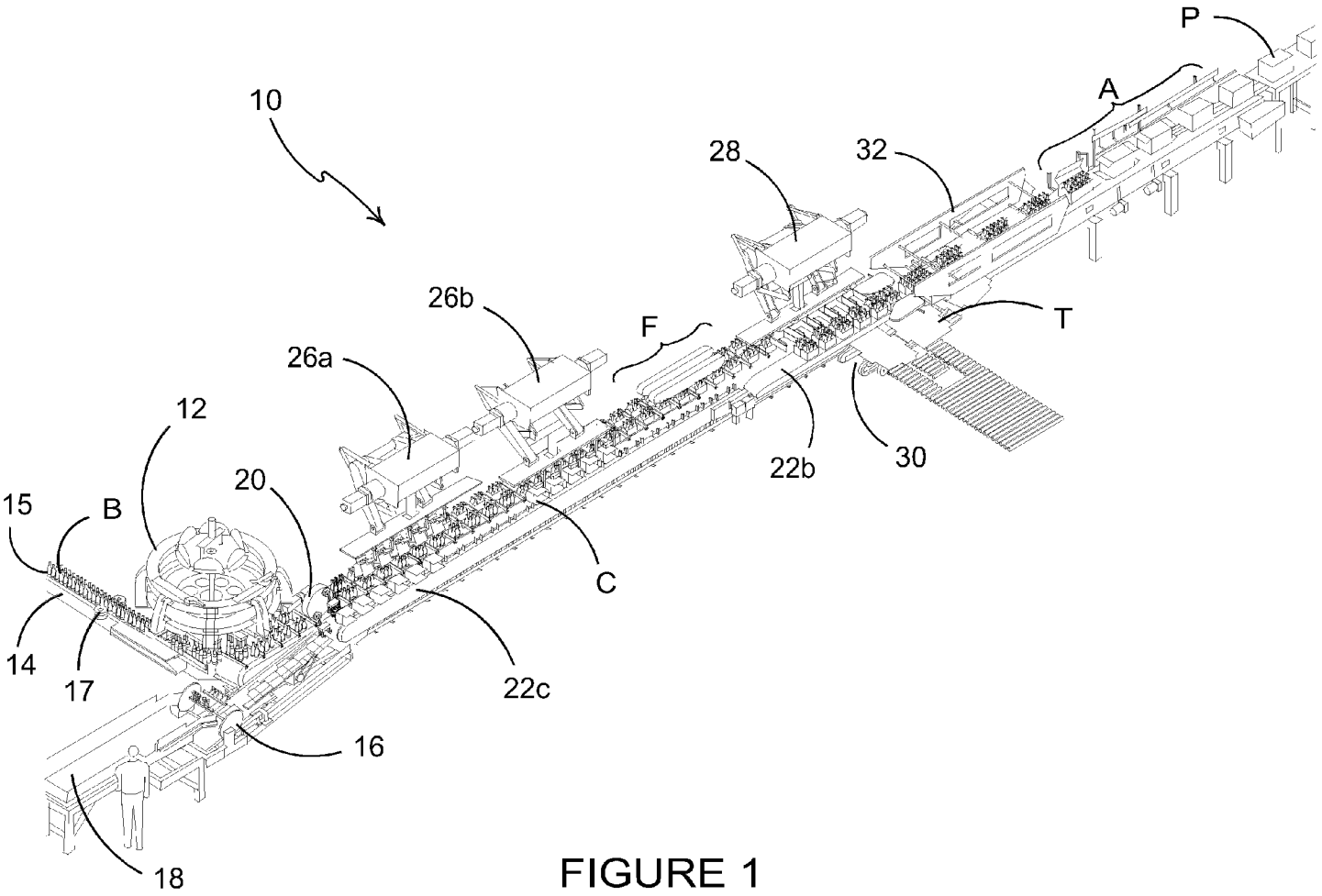
FIG. 1. is a perspective view from above of a packaging machine according to a first embodiment of the invention.

Referring to FIG. 1 there is shown a perspective view of a packaging machine 10 capable of accepting an input of primary products, such as, but not limited to, bottles or cans, hereinafter referred to as articles B.

An article processing device 12 receives the articles B which are output in a non-uniform and rapid manner from a filling or bottling line (not shown) and are delivered on a mass conveyor (not shown). Filtering guides (not shown) funnel an incoming mass of articles B into first and second lanes to create an incoming stream 14 of articles B that is two articles B wide. The articles B in the incoming stream 14 are conveyed upon a first conveyor 15 in first and second lanes. Article processing device 12 is the subject of co-pending patent application number GB0803910.9 filed 3 Mar. 2008 the contents of which are incorporated herein by reference.

A regulator 17 is used to space pairs of articles B from preceding and succeeding pairs of articles B and to control the pitch between pairs of articles B as they are conveyed into the article processing device 12. After the incoming stream 14 of articles B is regulated, the incoming stream 14 is acted upon by the article processing device 12 that picks up a group of articles B from the regulated stream. Preferably eight articles B in a 4×2 array are successively lifted from the output end of the regulated stream 14 (however other configurations are envisaged; for example, but not limited to, article arrays of 2×2, 3×2, 5×2 and 6×2); rotated and placed onto a second conveyor 23. The result is that a second stream 25 of articles B is created which is four articles B wide compared to the original width of the incoming stream 14 of two lanes of articles B, although production of a second stream 25 being narrower or wider is s envisaged, for example, but not limited to, 2, 3, 5 or 6 articles in width. The article processing device 12 places articles B such that twelve articles B are arranged between the flight bars or lugs 24; this is achieved by placing a first group of eight articles B such that four articles B are placed upon either side of a flight bar 24, subsequently the article processing device 12 places a second group of eight articles B between two successive flight bars 24. The flight bar 24 trailing the second group of eight articles B conveys the second group such that it catches up with the four articles B placed behind the previous flight bar 24. This may be achieved by providing a stationary platform 13 above the second conveyor 23 above which stationary platform 13 the flight bars 24 traverse; such that the articles B are stationary until engaged directly by the flight bars 24 or indirectly by the flight bars 24 by being engaged by moving articles B. The stationary platform 13 need only be long enough to form the article groups after which the articles B are transferred onto the second conveyor 23 by the flight bars 24. In alternative embodiments where different configurations are desired the article processing device 12 may pick and place larger or smaller groups of articles B as suggested above and may place half of a group of articles B or a whole group of articles B between the flight bars 24 or any integer multiple of either respectively. The second stream 25 of articles B is arranged such that two spaced apart groups of six articles B are formed in a 2×3 array between the flight bars 24, best illustrated in FIG. 2. This is achieved by releasing two articles B at a first location on the second conveyor 23 and then releasing the remaining two articles B at a second location transversely spaced apart from the first location.

A hopper 18 is loaded with carton blanks C, a feeder 16 removes the carton blanks C from the hopper 18 and places them upon a conveyor the carton blanks C are erected by a carton erector 20 which in this embodiment comprises grippers 40*a*, 40*b* coupled to a vacuum system (not shown) which grippers 40*a*, 40*b* grip an upwardly facing panel of the carton blank C and pull it away from a lower facing panel which is held in position by fixed guides (not shown); in this way the carton blank C is erected into a tubular form. Alternatively the cartons C may be erected into a tubular form by blowing air at the flat collapsed cartons C as is known in the art.

The erected cartons C are then received or placed on an outer one 22*c* of pair of third conveyors 22*a*, 22*c* each having lugs 34. In this embodiment the inner third conveyor 22*a* is lowered to a retracted position (best illustrated in FIG. 4) and only the outer third conveyor 22*c* is used to convey the cartons C. In alternative embodiments the outer third conveyor 22*c* may be moved either upstream (direction D2) or downstream (direction D1), preferably upstream, when cartons C are to be conveyed by only the outer third conveyor 22*c*.

Additionally or alternatively the outer third conveyor 22*c* may be moved transversely with respect to the inner third conveyor 22*a*.

The third conveyors 22*a*, 22*c* are parallel to second conveyor 23 which conveys the second stream 25 of articles B. In the embodiment shown the cartons C are of the basket carrier type having a centrally disposed handle, although alternative carton styles are envisaged such as fully enclosed cartons C. In the illustrated embodiment the handle of the basket carrier is disposed towards the second conveyor 23, in alternative embodiments the base of the basket carrier may be disposed nearest to the second conveyor 23.

A transfer device 26*a* transfers cartons C from the outer third conveyor 22*c* to the second conveyor 23. Transfer device 26*a* preferably comprises a tool head 19 of the type described in co-pending patent application GB 0812201.2 filed 4 Jul. 2008 and in GB 0812233.5 also filed 4 Jul. 2008 the whole contents of both of which are incorporated herein by reference. The tool head 19 comprises gripping means 29 for gripping the cartons C for example suction cups coupled to a vacuum system (not shown). In alternative embodiments it is envisaged that alternative tool heads could be utilised.

The transfer device 26*a* is articulated such that the tool head 19 thereof may be brought down into engagement with a selection of cartons C and moved in the transverse direction D5, which cartons C are then engaged by the tool head 19 and transferred by the transfer device 26*a* onto the second conveyor 23.

As both the second stream 25 of articles B and the cartons C are in continuous motion; whilst the cartons C are being engaged by the tool head 19 of the transfer device 26*a*, it is necessary to control that tool head 19 so as to synchronise the motion thereof with the motion of the cartons C, which the tool head 19 is to engage. The tool head 19 is thus controlled so as to move it upstream of the flow of cartons C such that it may then be accelerated in the direction D1 of flow of the cartons C in order to reach the same velocity as the cartons C that the tool head 19 is to engage. Once the velocity of the tool head 19 is matched with that of the cartons C that it is to engage, the engagement is effected using some gripping means 29 known in the art such as vacuum seals or mechanical grippers. The cartons C are then transferred from the outer third conveyor 22*c* and disposed about respective groups of articles B upon the second conveyor 23. Once the tool head 19 lifts the selected cartons C from the outer third conveyor 22*c*, the tool head 19 of the transfer device 26*a* is controlled to move back to an upstream position, in the direction indicated by arrow D2. This movement is performed so as to synchronise the tool head 19 and selected cartons C over respective groups of articles B upon the third conveyor 23. Before the cartons C can be released by the tool head 19, it is necessary for the tool head 19 to be accelerated in the direction D1 of the second conveyor 23 such that the cartons C and the second conveyor 23 have matching velocities. Once this is achieved, the transfer device 26*a* is controlled to lower the selected cartons C down over the selected groups of articles B upon third conveyor 23 and the tool head 19 is then controlled to release those cartons C. The transfer device 26*a* is then controlled to move the tool head 19 away from the deposited cartons C, and to return to its original position over the flow of cartons C upon the outer third conveyor 22*c*, with the tool head 19 returned to its upstream position, by movement in the direction indicated by arrow D2, in readiness to engage a subsequent selection of cartons C from the outer third conveyor 22*c* for transfer. In addition to being transferred between the outer third conveyor 22*c* and the second conveyor 23 the cartons C are rotated about an angle of 90 degrees indicated by direction arrow D3, since the cartons C are loaded upon the outer third conveyor 22*c* on side or end panel the tool head 19 rotates the cartons C about a horizontal axis in order that the articles B may be bottom loaded into the cartons C. This process is repeated continuously allow continuous packaging of the articles B.

In the illustrated embodiment the transfer device 26*a* engages with and transfers five cartons C simultaneously, however it is envisaged that in alternative embodiments a greater or lesser number of cartons C may be transferred for example, but not limited to, transferring eight cartons C simultaneously.

Optionally, a second transfer device 26*b* may be provided downstream, direction D1, of the first transfer device 26*a* to transfer a second group of cartons C from the outer third conveyor 22*c* to the second conveyor 23. The addition of a second transfer device 26*b* allows an increased number of cartons C to be processed and provides for a greater throughput of cartons C and articles B thereby allowing an increase in the packaging line speed which produces an increase in the number of completed packages output in a given period of time.

Figure 3:
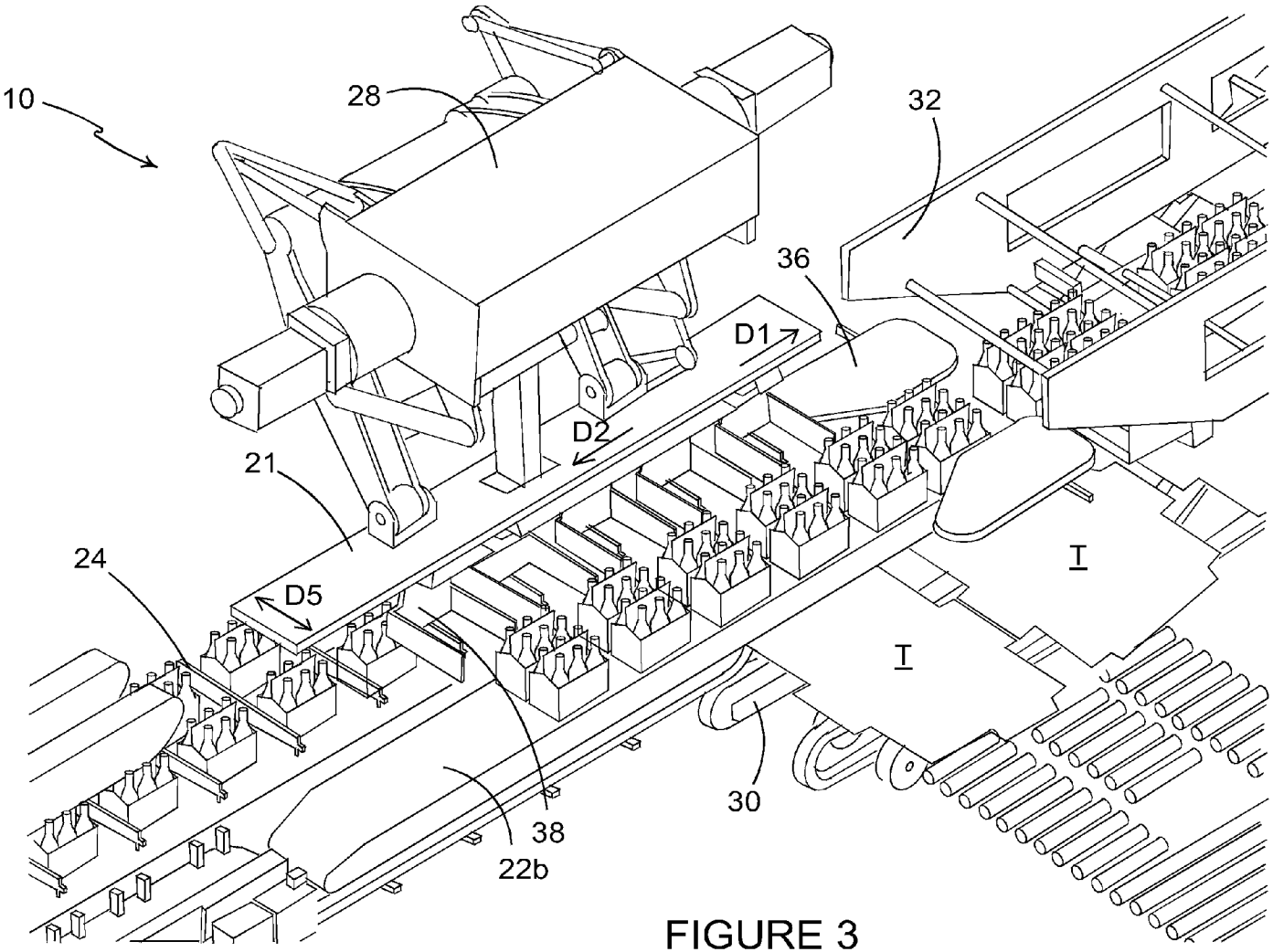
FIG. 3. is a perspective view from above of the output end of the packaging machine of FIG. 1.

The packaging machine 10 comprises a processing station F where assembly of the cartons C may be completed to form secondary packages, for example by construction of a base structure or panels about the bases of the articles B. Once the construction of the cartons C is completed a third transfer device 28 having a head 21 of the type described in GB 0812201.2 which is capable of moving in the direction D1. As illustrated in FIG. 3 the second conveyor 23 comprises a pair of completed cartons C transversely spaced apart from one another between each pair of flight bars 24, the third transfer device 28 comprises an engaging means 38 capable of engaging both or the cartons C and bringing them into close proximity by moving one towards the other and subsequently moving both cartons C onto a fourth conveyor 22*b*. Fourth conveyor 22*b* is parallel to second conveyor 23 and is substantially co-linear with the pair of third conveyors 22*a*, 22*c*. The third transfer device 28 thereby groups pairs of cartons C together, side by side, upon the fourth conveyor 22*b*.

In the illustrated embodiment a retarder 36 is provided to slow alternate pairs of cartons C such the pair of subsequent cartons C may catch up with the preceding pair of cartons C to form a group of four cartons C arranged in a 2×2 array, thereby creating a 6×4 array of twenty-four articles B. In alternative embodiments the retarder 36 may accelerate a pair of trailing cartons C to catch up with a pair of leading cartons C. In yet another embodiment of the invention the retarder 36 may be omitted, the head 21 of the third transfer device 28 may be configured to group the cartons C by moving them in both a transverse and longitudinal direction. This is affected by moving each of the engaging means 38 couple to the head 21 with respect to one another in the longitudinal direction indicated by arrows D1 and D2.

The grouped cartons C are then conveyed to a tertiary packaging subsystem which applies a tertiary carton T to the groups of cartons C to form a tertiary package P. A second hopper 30 provides tertiary cartons T to a conveyor arranged below fourth conveyor 22*b*. An overhead conveyor 32 synchronises or meters the grouped cartons C provided by the retarder 36 with the tertiary cartons T. The tertiary cartons T are assembled about the grouped cartons C at an assembly station A to produce the completed tertiary packages P, illustrated in FIG. 1.

Figure 2:
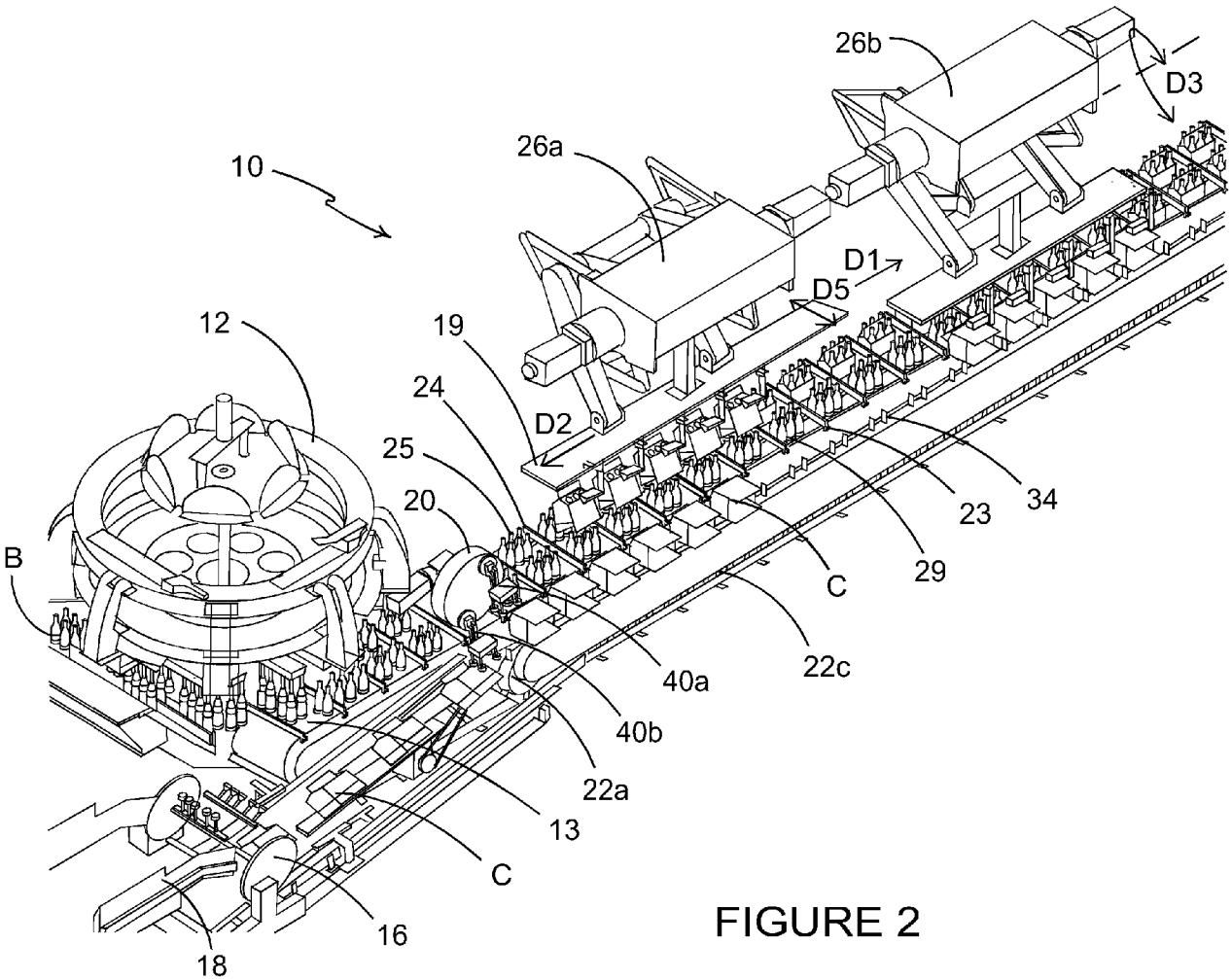
FIG. 2. is a perspective view from above of the input end of the packaging machine of FIG. 1.

Referring now to FIG. 4 to FIG. 11, alternative embodiments of the present invention are illustrated in which like numerals have, where possible, been used for like parts, and therefore only the differences from the embodiment illustrated in FIGS. 1 to 3 will be described in any greater detail.

Figure 4:
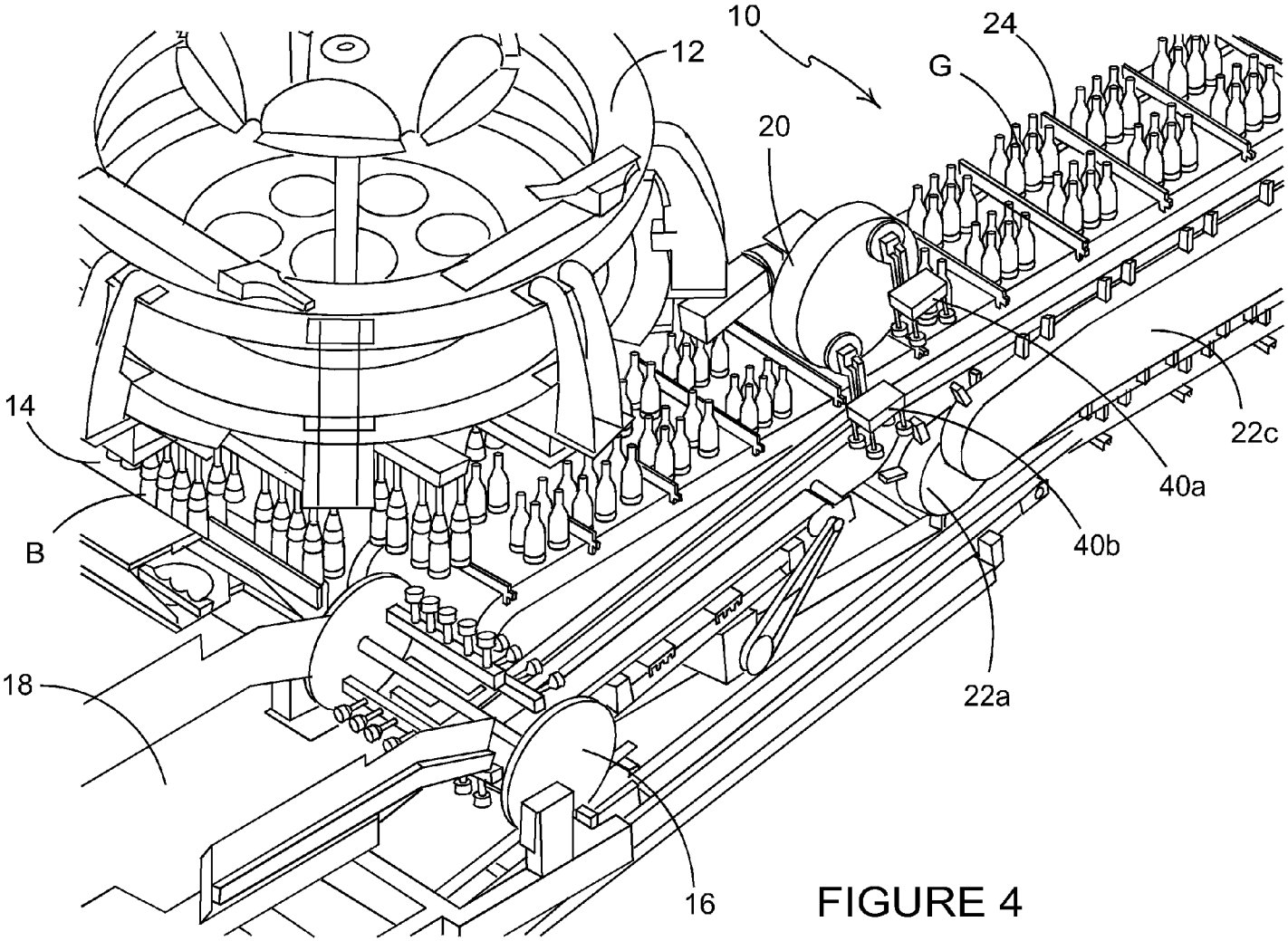
FIG. 4. is a perspective view from above of the input end of a packaging machine according to a second embodiment of the invention.

FIG. 4 illustrates the input end of the packaging machine 10 according to a second embodiment of the invention in this embodiment the articles B are packaged directly into the tertiary carton T; no cartons C are fed from the hopper 18 to the either of the third conveyors 22*a*, 22*c*. The second stream 25 of articles B is conveyed toward the output end, the first transfer device 26*a* is idle, as is the second transfer device 26*b* if present.

Figure 5:
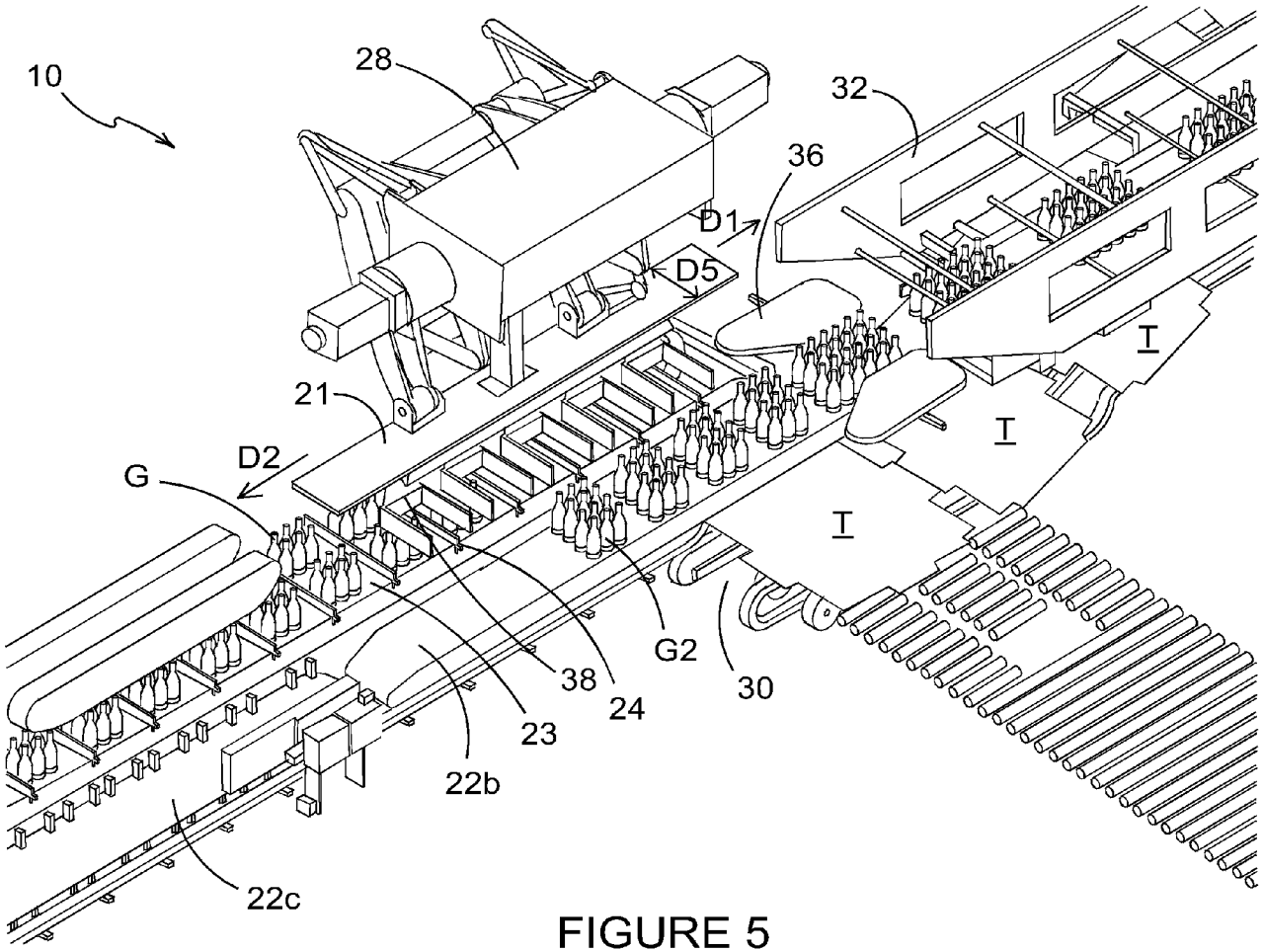
FIG. 5. is a perspective view from above of the output end of the packaging machine according to the second embodiment of the invention.

FIG. 5 illustrates the output end of the packaging machine 10 according to a second embodiment of the invention; the third transfer device 28 generates a single group G2 of twelve articles B in a 3×4 array on the fourth conveyor 22*b* from the two groups of six articles B on the second conveyor 23 which are created by the article processing device 12. The retarder 36 then creates groups of twenty-four articles B in array of 6×4 by retarding a leading group of twelve articles B such that a trailing group catches up with the leading group. Tertiary cartons T are then applied directly to the groups of twenty-four articles B, by top loading the articles B directly in to the tertiary carton T to form a tertiary package P. It is envisaged that the tertiary carton T could be a crate or tray or other suitable package. In another alternative embodiment the third transfer device 28 may be idle and the unpackaged or loose articles B may be transferred to one or both of the third conveyors 22*a*, 22*c* or the fourth conveyor 22*b* by either the first transfer device 26*a* or the second transfer device 26*b* or both.

Figure 6:
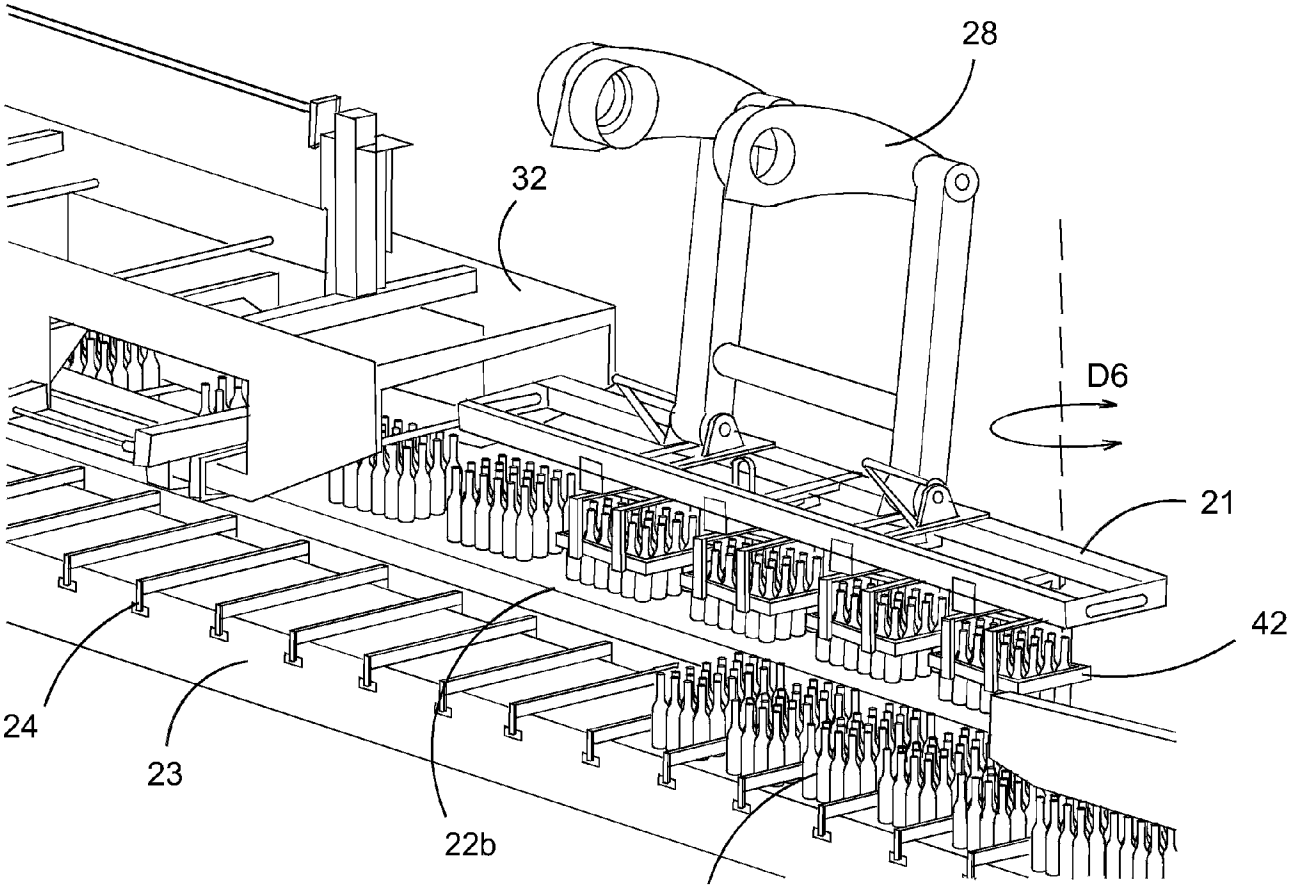
FIG. 6. is a perspective view from above of the output end of a packaging machine according to a third embodiment of the invention.

In a third embodiment of the present invention illustrated in FIG. 6 the article processing device 12 places groups G3 of twenty-four articles B between the flight bars 24 on the second conveyor 23. This is achieved by picking up the articles B from the input stream 14 in groups of 6×2 articles B and placing two such groups of 6×2 articles B between the flight bars 24. The third transfer device 28 then picks up the groups G3 of 6×4 articles B and places them upon the fourth conveyor 22*b*. The gripper heads 42 may also rotate in the direction D6 about a vertical axis such that the leading face of the groups G3 comprises four articles B rather than 6 articles as was the case when loaded on the second conveyor 23.

Figure 7:
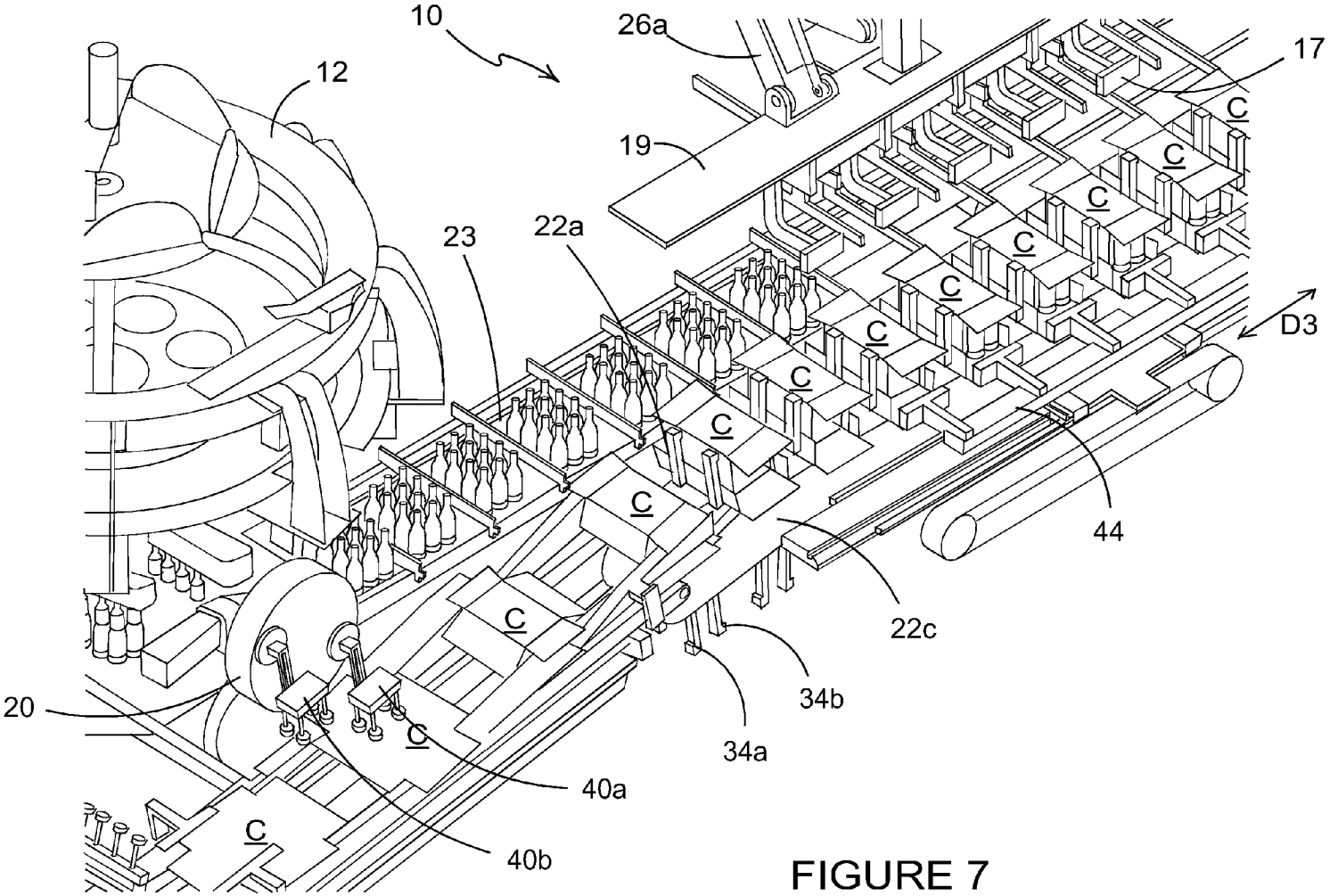
FIG. 7. is a perspective view from above of the input end of a packaging machine according to a fourth embodiment of the invention.

FIG. 7 illustrates a fourth embodiment of the present invention in which the articles are side loaded into a fully enclosed carton C. The article processing device 12 places groups of twelve articles B in a 4×3 array between the flight bars 24 on the second conveyor 23. The carton hopper 18 is loaded with fully enclosed cartons C which have a tubular structure which has been folded into a flat collapsed form which flat collapsed cartons C are feed onto a conveyor by feeder 16, the flat collapsed cartons C are then erected by a carton erector 20 having gripper heads 40*a*, 40*b*, alternatively the cartons C may be erected into a tubular form by using an air blower (not shown) which blows air at the flat collapsed cartons C as is known in the art. The application of air pressure to at least one end of the flat collapsed cartons C causes the flattened tube to be erected. In some embodiments the packaging machine may comprise more than one type of carton erection means for example it may comprise a carton erector 20 of the type shown in FIG. 7 which may be used for erecting some carton types and also comprise an air blower which may be used for other carton types. The outer third conveyor 22*c* and inner third conveyor 22*a* have been brought into alignment, in the illustrated embodiment by raising the inner third conveyor 22*a*. In alternative embodiments this may be achieved by moving the outer third conveyor 22*c* for example in a downstream direction D1; in such embodiments the conveyor supplying the third conveyors 22*a*, 22*c* with tubular cartons C may be adjusted to ensure the cartons C are fed onto the third conveyors 22*a*, 22*c*. In addition the separation between the inner and outer conveyors 22*a*, 22*c* may be increased or decreased by moving one of the conveyors transversely with respect to the other, preferably by moving the outer third conveyor 22*c* whilst the inner third conveyor 22*a* remains fixed; this allows the packaging machine 10 to load cartons of different sizes. The inner and outer third conveyors 22*a*, 22*c* are aligned such that their respective output ends are aligned with the input end of fourth conveyor 22*b*. The cartons C are then conveyed upon the pair of third conveyors 22*a*, 22*c* each of the third conveyors 22*a*, 22*c*. The third conveyors 22*a*, 22*c* each comprise a pair of lugs 34*a*, 34*b*. Lugs 34*a* are mounted upon separate chain to the lugs 34*b* such that the separation between lugs 34*a* and lugs 34*b* may be adjusted to accommodate cartons C of different sizes and to adjust the pitch of the cartons C. Lugs 34*a*, 34*b* have a greater height than those of the previous embodiments so that they can provide support to the cartons C whilst they are being loaded. This is achieved by providing lugs 34*a*, 34*b* which are telescopic and can be extended for use when side loading cartons C. In other embodiments the lugs are retracted so that they are shorter which facilitates easier handling of the cartons C when transferring them to second conveyor 23. Alternatively the lugs 34*a*, 34*b* may be detachable from the third conveyors 22*a*, 22*c* such that they can be replaced with taller or shorter lugs as required or the lugs may be formed from two or more parts hinged to one another which may be folded about the hinges between extended and retracted positions.

First transfer device 26*a* has tool 17 which is adapted for pushing the groups of articles B from the second conveyor 23 into the cartons C upon the pair of third conveyors 22*a*, 22*c*. Again the tool head 19 is synchronised with the forward motion of the articles B and the cartons C such that both are continuously in motion during the loading process.

Optionally a pusher 44 is provided to oppose the tool 17 to ensure that when the articles B are transferred to the cartons C they do not fall out of the cartons C and/or that they are accurately aligned within the cartons C for assembly of the end closure panels of the cartons C.

Figure 8:
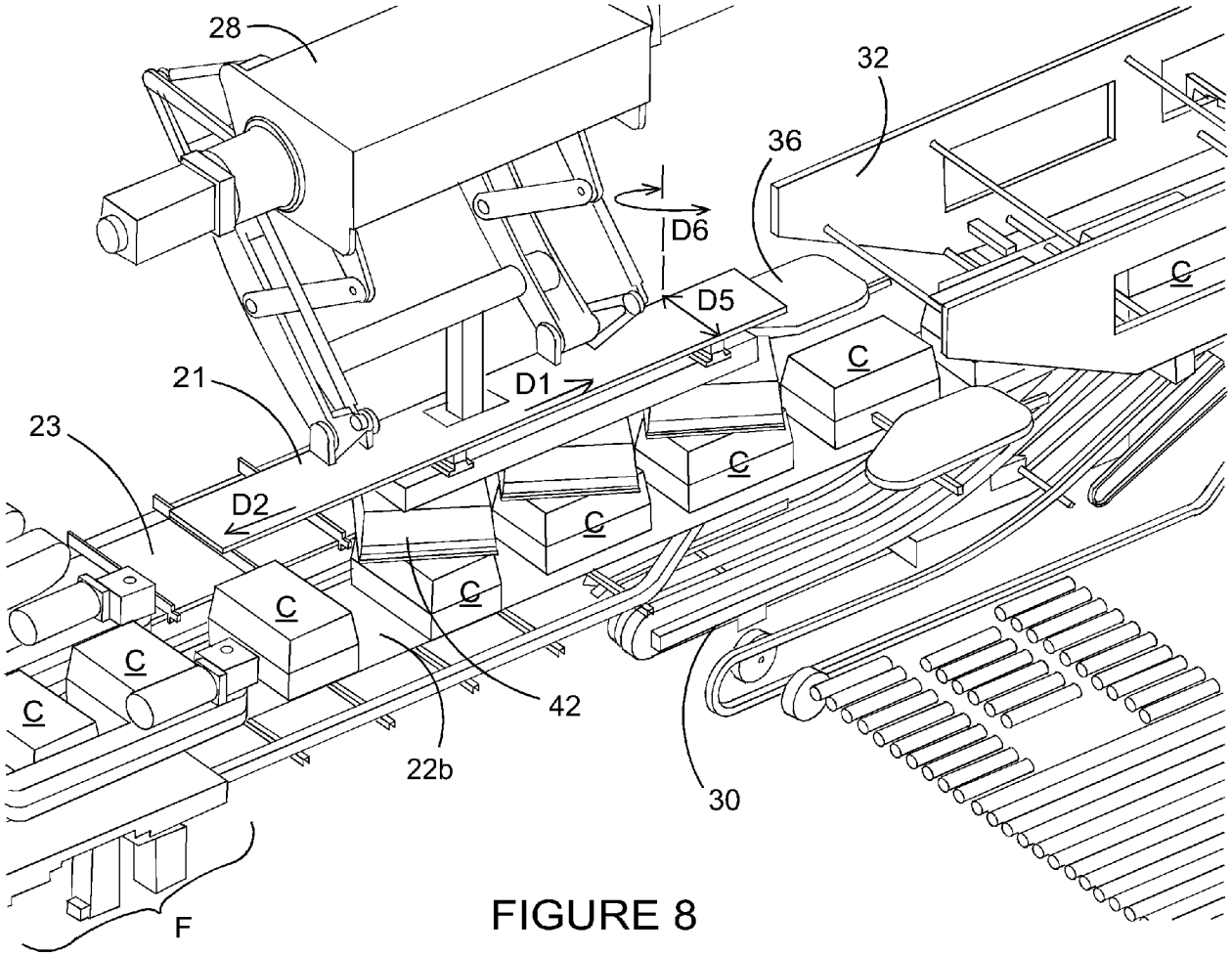
FIG. 8. is a perspective view from above of the output end of the packaging machine according to a fourth embodiment of the invention.

Turning now to FIG. 8 there is illustrated an output end of the packaging machine 10 according to the fourth embodiment of the invention in which the transfer device 28 has been adapted for reorganising the completed cartons C after they exit the processing station F. The loaded cartons C are transferred from the pair of third conveyors 22*a*, 22*c* to the fourth conveyor 22*b*. The tool head 21 comprises gripper heads 42 which rotate the cartons about 90 degrees such that the short edge of each carton C is leading. Optionally this stage may be omitted and the cartons C may continue with the long edge of each carton C leading, in such case the third transfer device 28 is idle.

The cartons C are conveyed by overhead conveyor 32 to be placed upon pallets for subsequent shipping alternatively they may be packaged in tertiary cartons T (not shown) prior to being placed in pallets.

Figure 9:
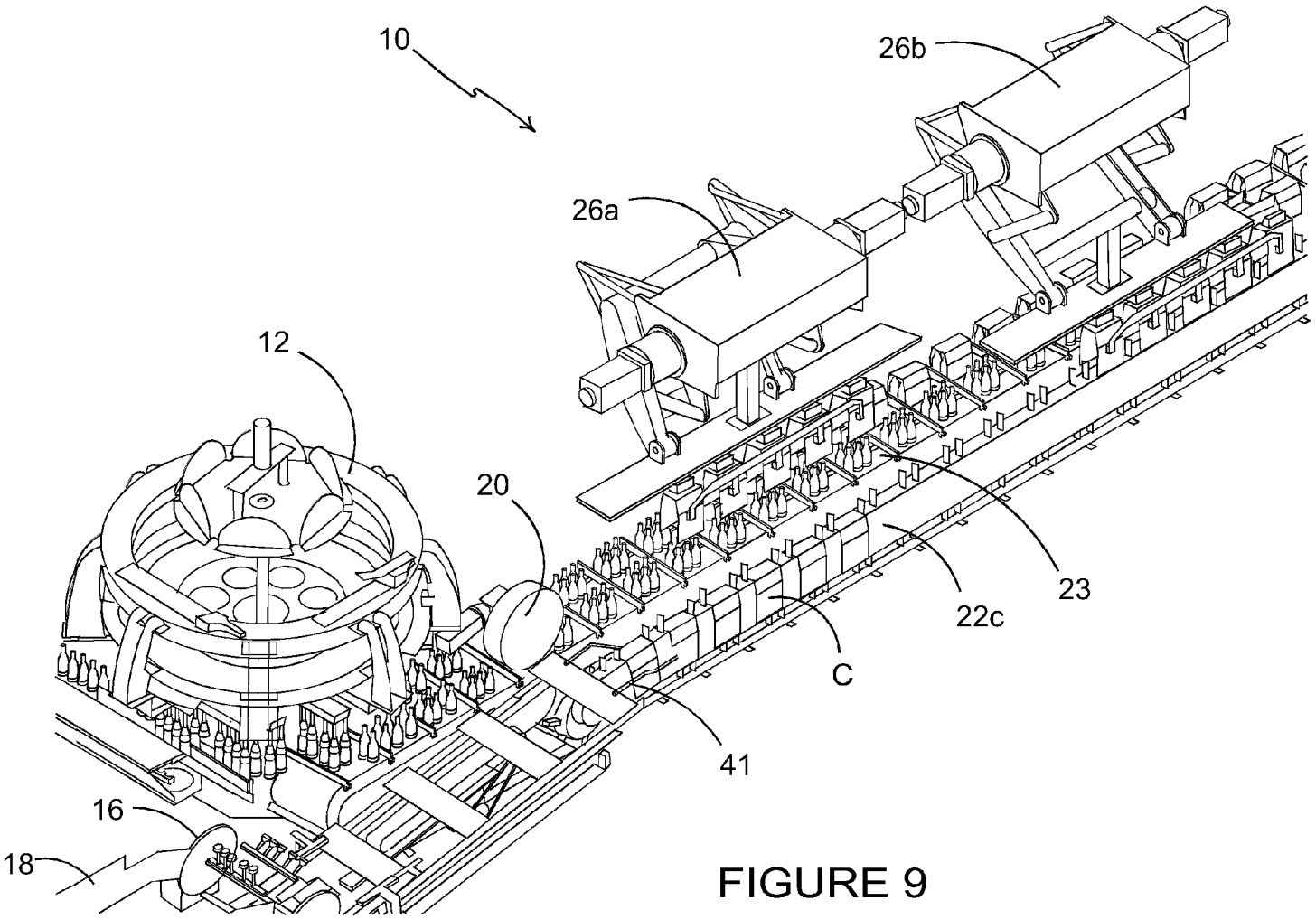
FIG. 9. is a perspective view from above of the input end of a packaging machine according to a fifth embodiment of the invention.

FIG. 9 illustrates a fifth embodiment of the invention in which the packaging machine 10 applies wrap-around cartons C to groups of articles B upon the second conveyor 23. Carton blanks C are provided from a hopper 18 and placed upon a conveyor by feeder 16. The carton blanks C are folded by fixed guides 41 into inverted U-shapes and placed about the outer conveyor 22*c* of the pair of third conveyors 22*a*, 22*c*. The inner third conveyor 22*a* of the pair of third conveyors 22*a*, 22*c* has been moved out of alignment with the inner third conveyor 22*a* as it was in the first, second and third embodiments; again the outer third conveyor 22*c* may be moved whereas the inner third conveyor 22*a* remains fixed.

Figure 10:
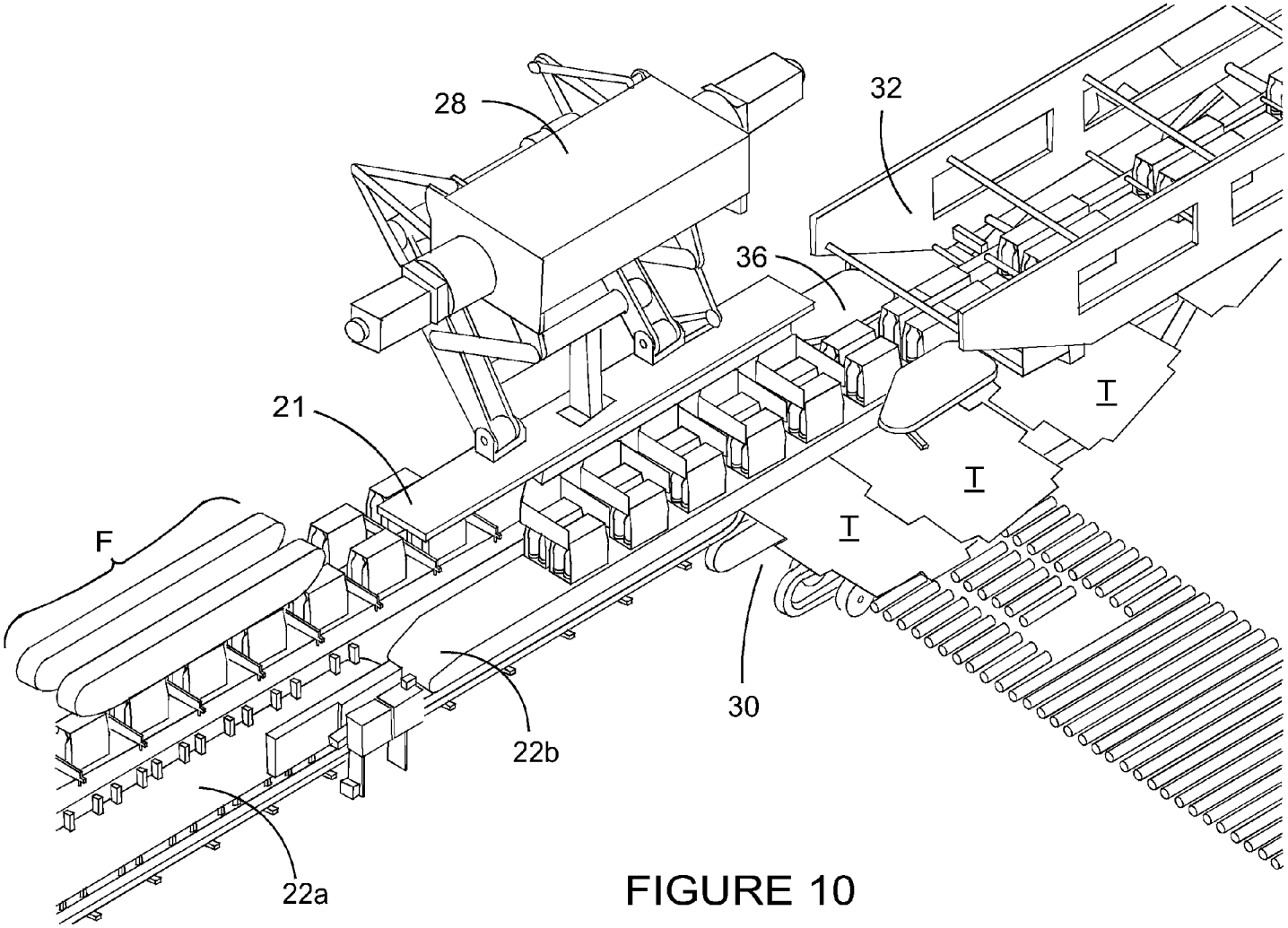
FIG. 10. is a perspective view from above of the output end of the packaging machine according to a fifth embodiment of the invention.

First transfer device 26*a* then picks up the folded carton blanks C from said outer third conveyor 22*c* and places them about groups of articles B on second conveyor 23 as described previously. Again an optional a second transfer device 26*b* may be provided. The output end of packaging machine 10 is shown in FIG. 10, the assembly of the wrap-around cartons C is completed at processing station F where the base structure of the cartons C is erected about the bases of the grouped articles B. The cartons C are then transferred to the fourth conveyor 22*b* by the third transfer device 28 as previously described. A retarder 36 may then group pairs of cartons C into larger groups prior to application of a tertiary carton T from the second hopper 30. Again the retarder 36 may be removed and the grouping may be carried out by the third transfer device 28.

Figure 11:
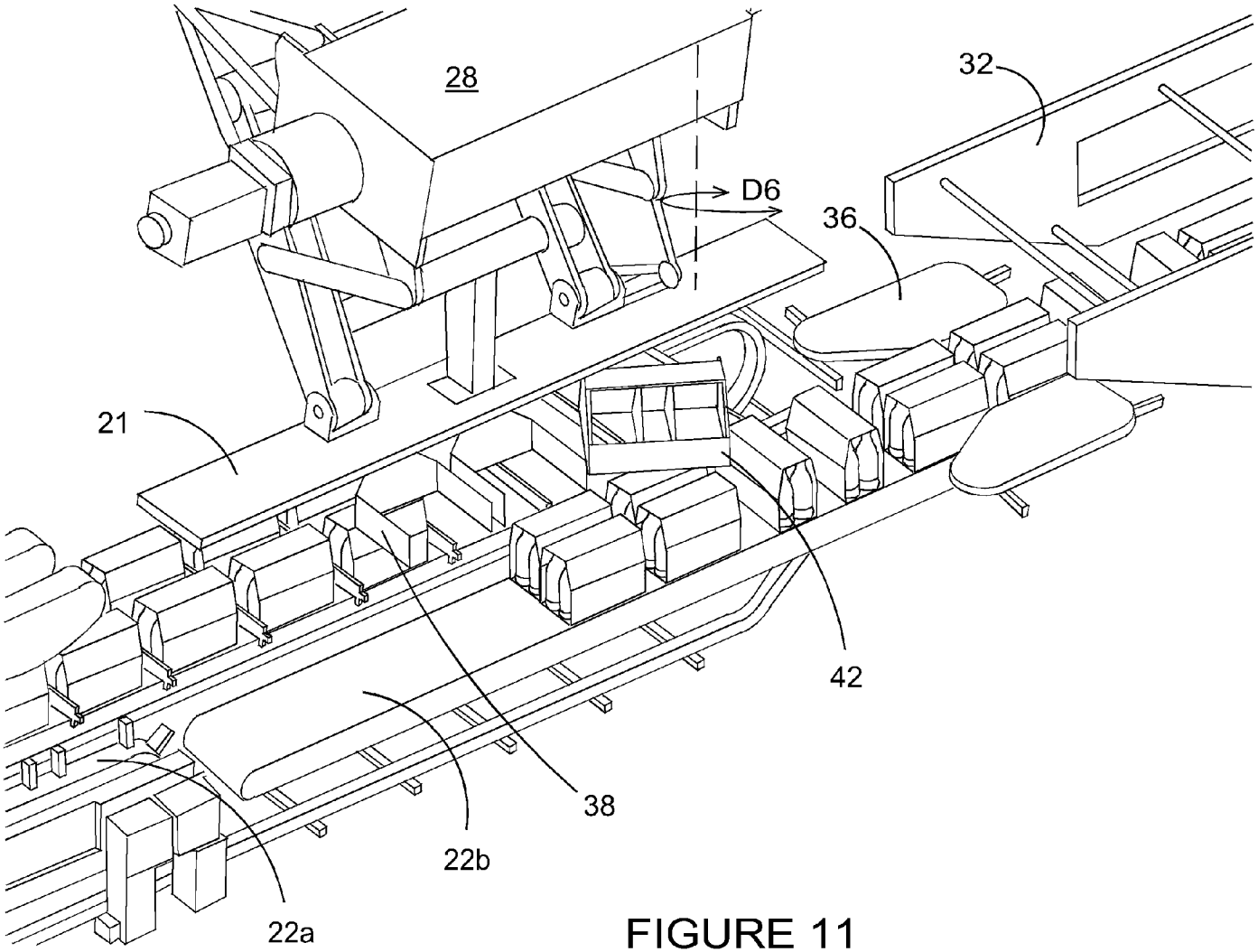
FIG. 11. is a perspective view from above of the output end of a packaging machine according to a sixth embodiment of the invention.

FIG. 11 shows a sixth embodiment of the invention in which the wrap-around cartons package eight articles B in an array of 2×4 articles. The head 21 comprises engaging means 38 and rotator 42. Rotator 42 transfers a pair of cartons C from the second conveyor 23 to the fourth conveyor 22*b* and imparts 90 degree rotation to them whereas engaging means 38 simply transfers a pair of cartons C without changing their orientation.

The retarder 36 then groups three cartons C together to form a single group for packaging into tertiary carton (not shown) such that one carton C has its long edge leading and the other two cartons C have their short edges leading. Again it is envisaged that third transfer device 28 could group the cartons C together in replacement of the retarder 36.

One advantage of the present invention over the packaging machine disclosed in GB 0812201.2 and GB0812233.5 is that the articles are handled less by robots, thereby reducing the complexity of the machine and reducing the likelihood of damage to the articles, another advantage is that the present invention requires only two parallel lines thereby reducing the cost of the machine again reducing the complexity and reducing the packaging machine's footprint, the amount of floor space required to accommodate the machine. The number of required transfer devices is also reduced, again improving cost efficiency and reducing the complexity of the control systems required.

An advantage of moving the outer third conveyor and inner third conveyor with respect to one another when only one of the conveyors is being utilised is that the other of the conveyors can be moved to provide space for the cartons C to be folded prior to being placed upon the third conveyor 22*a*, 22*c*.

It can be appreciated that various changes may be made within the scope of the present invention, for example, the size and shape of the panels and apertures may be adjusted to accommodate articles of differing size or shape. In other embodiments of the invention it is envisaged that features of any one of the embodiment may be used in combination with or replacement of features from any one of the other embodiments described or illustrated herein. It is also envisaged that the first transfer device may It will be recognised that as used herein, directional references such as "top", "bottom", "front", "back", "end", "side", "inner", "outer", "upper" and "lower" do not limit said features to such orientation, but merely serve to distinguish said features from one another.

The invention claimed is:

1. A packaging machine having plural modes of operation for continuously packaging articles into cartons of different types comprising:

a first processing line for receiving articles from an incoming stream;

a second processing line for receiving empty cartons from a feeder and defining a direction of carton flow;

a third processing line for receiving tertiary cartons from a hopper;

a first handling device for transferring either articles or empty cartons between the first and second processing lines depending upon the mode of operation of the machine, wherein the first handling device includes a tool head mounted for controlled linear acceleration in the direction of carton flow to match a velocity of the cartons that the tool head is to engage for transfer, and for articulated movement in a direction transverse to the direction of carton flow to transfer engaged cartons from one processing line to another; and a second handling device downstream from the first handling device for transferring either articles or secondary packages consisting of articles in cartons between the first and third processing lines depending upon the mode of operation of the machine, wherein the second handling device includes a tool head mounted for controlled linear acceleration in the direction of carton flow to match a velocity of the secondary packages that the tool head is to engage for transfer, and for articulated movement in a direction transverse to the direction of carton flow to transfer engaged secondary packages from one processing line to another;

wherein the machine is configured to operate in a first mode of operation in which empty cartons from the feeder are engaged by the tool head of the first handling device while it is moving in the direction of carton flow and transferred by the tool head of the first handling device from the second processing line to the first processing line to receive a group of articles therein from the incoming stream to form secondary packages on the first processing line, which secondary packages are engaged by the tool head of the second handling device while it is moving in the direction of carton flow and transferred by the tool head of the second handling device from the first processing line to the third processing line, where a retarder groups plural secondary cartons together for application of tertiary cartons from the hopper thereto so as to form tertiary packages of plural secondary cartons, and wherein the machine is configured to operate in a second mode of operation in which articles from the incoming stream are transferred from the first processing line into empty cartons on the second processing line by the tool head of the first handling device to form secondary packages on the second processing line, which secondary packages are engaged by the tool head of the second handling device and transferred by the tool head of the second handling device from the second processing line to the third processing line, where the retarder groups plural secondary cartons together prior to the application of a tertiary carton from the hopper thereto so as to form a tertiary package of plural secondary packages, and wherein the machine is configured to operate in a third mode of operation in which articles from the incoming stream are engaged by and transferred from the first processing line by either the tool head of the first handling device or the tool head of the second handling device to the third processing line for direct application of tertiary cartons from the hopper to groups of the articles.

2. A packaging machine according to claim 1 wherein at least two of said first, second or third processing lines are parallel to one another.

3. A packaging machine according to claim 1 wherein at least two of the first, second or third processing lines are co-linear.

4. A packaging machine according to claim 1 wherein at least one of said processing lines at least partially overlaps in the direction of carton flow with another of said processing lines.

5. A packaging machine according to claim 1 wherein the second processing line comprises a conveyor which is adaptable to accommodate cartons of different types.

6. A packaging machine according to claim 5 wherein said second processing line comprises a pair of parallel conveyors laterally spaced apart from one another and moveable with respect to one another so as to adjust the lateral spacing between the conveyors.

7. A packaging machine according to claim 5 wherein said second processing line comprises a pair of parallel conveyors laterally spaced apart from one another and moveable with respect to one another in the direction of the conveyors.

8. A packaging machine according to claim 1 wherein the third processing line can receive an input of products to be conveyed/processed from the first processing line or an input of secondary packages from the first or second processing lines.

9. A packaging machine according to claim 8 wherein the third processing line is coupled to the first and second processing lines to receive products at its end from one of said first or second processing lines and from the side from the other of said first or second processing lines.

10. A packaging machine according to claim 1 wherein in the first mode of operation the cartons are either bottom loaded with articles or wrapped around groups of articles depending upon the carton type.

11. A packaging machine according to claim 1 wherein in the second mode of operation the cartons are either top loaded or side loaded with articles depending upon the carton type.

12. A packaging machine according to claim 1 wherein the second processing line includes a feeder for supplying carton blanks and an erection device for erecting said carton blanks.

13. A packaging machine according to claim 1 wherein the third processing line includes a feeder for supplying tertiary carton blanks and an erection mechanism for erecting said tertiary carton blanks.

14. A packaging machine according to claim 1 wherein the first and second processing lines are parallel to one another, and overlap in a direction transverse to carton flow at least in part, the second and third processing lines are co-linear with one another and the first and third processing lines are parallel with one another and overlap in a direction transverse to article flow at least in part.

15. A packaging machine having plural modes of operation for packaging articles into cartons of different types comprising:

a first processing line for receiving articles from an incoming stream;

a second processing line for receiving empty cartons from a feeder and defining a direction of carton flow;

a third processing line for receiving tertiary cartons from a hopper;

a first handling device including a tool head for engaging and transferring either articles or empty cartons between the first and second processing lines depending upon a mode of operation of the machine, wherein the tool head of the first handling device is mounted for controlled linear acceleration in the direction of carton flow to match a velocity of the cartons that the tool head is to engage for transfer, and for articulated movement in a direction transverse to the direction of carton flow to transfer engaged cartons from one processing line to another; and a second handling device downstream from the first handling device and including a tool head mounted for engaging and transferring either articles or secondary packages consisting of articles in cartons between the first and third processing lines depending upon a mode of operation of the machine, wherein the tool head of the second handling device is mounted for controlled linear acceleration in the direction of carton flow to match a velocity of the secondary packages that the tool head is to engage for transfer, and for articulated movement in a direction transverse to the direction of carton flow to transfer engaged secondary packages from one processing line to another.

16. A packaging machine according to claim 15 wherein the machine is configured to operate in a first mode of operation in which empty cartons from the feeder are engaged by the tool head of the first handling device while it is moving in the direction of carton flow and transferred by the tool head of the first handling device from the second processing line to the first processing line to receive a group of articles therein from the incoming stream to form secondary packages on the first processing line.

17. A packaging machine according to claim 15 wherein in the first mode of operation the secondary packages are engaged by the tool head of the second handling device while it is moving in the direction of carton flow and transferred by the tool head of the second handling device from the first processing line to the third processing line, where a retarder groups plural secondary cartons together for application of tertiary cartons from the hopper thereto so as to form tertiary packages of plural secondary cartons.

18. A packaging machine according to claim 15 wherein the machine is configured to operate in a second mode of operation in which articles from the incoming stream are transferred from the first processing line into empty cartons on the second processing line by the tool head of the first handling device to form secondary packages on the second processing line.

19. A packaging machine according to claim 18 wherein in the second mode of operation the secondary packages are engaged by the tool head of the second handling device and transferred by the tool head of the second handling device from the second processing line to the third processing line, where a retarder groups plural secondary cartons together prior to the application of a tertiary carton from the hopper thereto so as to form a tertiary package of plural secondary packages.

20. A packaging machine according to claim 15 wherein the machine is configured to operate in a third mode of operation in which articles from the incoming stream are engaged by and transferred from the first processing line by either the tool head of the first handling device or the tool head of the second handling device to the third processing line for direct application of tertiary cartons from the hopper to groups of the articles.

* * * * *